US011286874B2

(12) United States Patent
Mollar et al.

(10) Patent No.: US 11,286,874 B2
(45) Date of Patent: Mar. 29, 2022

(54) METHOD FOR FUEL INJECTOR CHARACTERIZATION

(71) Applicant: GM Global Technology Operations LLC, Detroit, MI (US)

(72) Inventors: Andrea Mollar, Turin (IT); Stefano Nieddu, Turin (IT); Paul Leondardo Claude, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 100 days.

(21) Appl. No.: 16/551,095

(22) Filed: Aug. 26, 2019

(65) Prior Publication Data

US 2021/0062749 A1 Mar. 4, 2021

(51) Int. Cl.
*F02D 41/38* (2006.01)
*F02D 41/22* (2006.01)

(52) U.S. Cl.
CPC ..... *F02D 41/3872* (2013.01); *F02D 41/22* (2013.01); *F02D 2041/225* (2013.01)

(58) Field of Classification Search
CPC ..... F02D 41/3872; F02D 41/22; F02D 2041/225; F02D 2200/0616
USPC ..... 123/198 D, 479; 701/107; 73/114.38, 73/114.43
See application file for complete search history.

(56) References Cited

U.S. PATENT DOCUMENTS

| | | | | |
|---|---|---|---|---|
| 7,523,743 | B1 * | 4/2009 | Geveci | F02D 41/3863 123/456 |
| 10,094,322 | B1 | 10/2018 | Nieddu et al. | |
| 2003/0172720 | A1 * | 9/2003 | Sweetland | F02M 65/00 73/49.7 |
| 2008/0041331 | A1 * | 2/2008 | Puckett | F02D 41/38 123/198 D |
| 2011/0036329 | A1 * | 2/2011 | Jung | F02D 41/3836 123/456 |
| 2016/0215708 | A1 | 7/2016 | Nieddu et al. | |
| 2018/0017010 | A1 | 1/2018 | Nieddu et al. | |
| 2018/0230933 | A1 | 8/2018 | Nieddu et al. | |
| 2019/0003414 | A1 * | 1/2019 | Nieddu | F02D 41/3872 |

* cited by examiner

*Primary Examiner* — Hai H Huynh
*Assistant Examiner* — Diem T Tran
(74) *Attorney, Agent, or Firm* — Vivacqua Crane PLLC

(57) ABSTRACT

A method of operating a fuel injection system for a motor vehicle includes one or more of the following: operating a fuel injector to perform a fuel injection, the fuel injector being in fluid communication with a fuel rail; sampling a rail pressure in the fuel rail during the fuel injection; regulating the rail pressure at a desired injection pressure, $P_{inj}$, to the fuel injector; measuring an overall leakage on variations of the rail pressure across an engine cycle for the motor vehicle and between two engine positions of an internal combustion engine for the motor vehicle; and restarting a new measurement cycle for a new pressure measurement target.

16 Claims, 3 Drawing Sheets

METHOD FOR FUEL INJECTOR CHARACTERIZATION

INTRODUCTION

The present disclosure pertains to a method of operating an internal combustion engine of a motor vehicle. More specifically, the present disclosure relates to a method of characterizing a fuel injection for the internal combustion engine.

It is known that an internal combustion engine of a motor vehicle generally includes a fuel injection system having a high pressure fuel pump, which delivers fuel at high pressure to a fuel rail, and a plurality of fuel injectors in fluid communication with the fuel rail. Each injector is provided for injecting metered quantities of fuel inside a corresponding combustion chamber of the engine. Conventionally, each fuel injector performs a plurality of injection pulses per engine cycle, according to a multi-injection pattern. This multi-injection pattern usually includes a main injection, which is executed to generate torque at the crankshaft, and several smaller injections, which may be executed before the main injection (e.g. pilot-injections and pre-injections) and/or after the main injection (e.g. after-injections and post-injections). Each of these small injection pulses is made to inject into the combustion chamber a small quantity of fuel with the aim of reducing polluting emissions and/or combustion noise of the internal combustion engine.

The fuel injectors are essentially embodied as electromechanical valves having a needle, which is normally biased in a closed position by a spring, and an electro-magnetic actuator (e.g. solenoid), which moves the needle towards an open position in response of an energizing electrical current. The energizing electrical current is provided by an electronic control unit, which is generally configured to determine the fuel quantity to be injected by each single injection pulse, to calculate the duration of the energizing electrical current (i.e. the energizing time) needed for injecting the desired fuel quantity, and finally to energize the fuel injector accordingly.

However, it may happen that the fuel quantity actually injected during an injection pulse is different from the desired one. This undesirable condition may be caused by several factors, including a drop of the rail pressure. These pressure drops may occur during normal engine operations by leakages in the rail multi-injection events and consequent pressure wave propagation.

Thus, while current fuel injection systems achieve their intended purpose, there is a need for a new and improved method for injecting fuel into a combustion chamber of internal combustion engines.

SUMMARY

According to several aspects, a method of operating a fuel injection system for a motor vehicle includes one or more of the following: operating a fuel injector to perform a fuel injection, the fuel injector being in fluid communication with a fuel rail; sampling a rail pressure in the fuel rail during the fuel injection; regulating the rail pressure at a desired injection pressure, $P_{inj}$, to the fuel injector; measuring an overall leakage on variations of the rail pressure across an engine cycle for the motor vehicle and between two engine positions of an internal combustion engine for the motor vehicle; and restarting a new measurement cycle for a new pressure measurement target.

In an additional aspect of the present disclosure, restarting includes restarting when a current pressure level is utilized as a new pressure measurement target.

In another aspect of the present disclosure, the overall leakage on the variations of the rail pressure defined as $DP_{LEAK}=P_{a,LEAK}-P_{b,\ LEAK}$.

In another aspect of the present disclosure, $P_{a,LEAK}$ is measured at $\Theta_a$ and $P_{b,\ LEAK}$ is measured at $\Theta_b$, where $\Theta_a$ and $\Theta_b$ are two different angles of a crankshaft of the internal combustion engine.

In another aspect of the present disclosure, the method further includes energizing the injector with an energization-time, $ET_{inj}$, after an inherent cylinder top-dead-center, TDC, to not produce a torque.

In another aspect of the present disclosure, the method further includes measuring injection and leakage effects on the rail pressure variation defined as $DP_{INJ+LEAK}=P_{a,INJ}-P_{b,INJ}$.

In another aspect of the present disclosure, $P_{a,INJ}$ is measured at $\Theta_a$ and $P_{b,\ INJ}$ is measured at $\Theta_b$.

In another aspect of the present disclosure, the method further includes calculating the injection effect on the rail pressure defined as $DP_{inj}=DP_{INJ+LEAK}-DP_{LEAK}$.

In another aspect of the present disclosure, the method further includes calculating an actual injected quantity, $Q_{inj}$, as a function of $DP_{inj}$ and $P_{inj}$.

In another aspect of the present disclosure, the method further includes collecting a characterization point as a function of $Q_{inj}$, $P_{inj}$ and $ET_{inj}$ into memory of an electronic control unit.

According to several aspects, a method of operating a fuel injection system for a motor vehicle includes one or more of the following: operating a fuel injector to perform a fuel injection, the fuel injector being in fluid communication with a fuel rail; sampling a rail pressure in the fuel rail during the fuel injection; regulating the rail pressure at a desired injection pressure, $P_{inj}$, to the fuel injector; after the desired injection pressure, $P_{inj}$, is reached, switching off a high pressure pump and closing a pressure regulator; measuring an overall leakage on variations of the rail pressure across an engine cycle for the motor vehicle and between two engine positions of an internal combustion engine for the motor vehicle; energizing the injector with an energization-time, $ET_{inj}$, after an inherent cylinder top-dead-center, TDC, to not produce a torque; calculating an injection effect on the rail pressure, $DP_{inj}$; calculating an actual injected quantity, $Q_{inj}$, as a function of $DP_{inj}$ and $P_{inj}$; collecting a characterization point as a function of $Q_{inj}$, $P_{inj}$ and $ET_{inj}$ into memory of an electronic control unit; and restarting a new measurement cycle for a new pressure measurement target or restarting when a current pressure level is utilized as a new pressure measurement target.

In another aspect of the present disclosure, the overall leakage on the variations of the rail pressure is defined as $DP_{LEAK}=P_{a,LEAK}-P_{b,\ LEAK}$, where $P_{a,LEAK}$ is measured at $\Theta_a$ and $P_{b,\ LEAK}$ is measured at $\Theta_b$, where $\Theta_a$ and $\Theta_b$ are two different angles of a crankshaft of the internal combustion engine.

In another aspect of the present disclosure, the method further includes measuring injection and leakage effects on the rail pressure variation defined as $DP_{INJ+LEAK}=P_{a,INJ}-P_{b,INJ}$ and wherein $P_{a,INJ}$ is measured at $\Theta_a$ and $P_{b,INJ}$ is measured at $\Theta_b$.

In another aspect of the present disclosure, the injection effect on the rail pressure is defined as $DP_{inj}=DP_{INJ+LEAK}-DP_{LEAK}$.

In another aspect of the present disclosure, the method further includes collecting a characterization point as a function of $Q_{inj}$, $P_{inj}$ and $ET_{inj}$ into memory of an electronic control unit.

According to several aspects, a method of operating a fuel injection system for a motor vehicle includes one or more of the following: operating a fuel injector to perform a fuel injection, the fuel injector being in fluid communication with a fuel rail; sampling a rail pressure in the fuel rail during the fuel injection; regulating the rail pressure at a desired injection pressure, $P_{inj}$, to the fuel injector; after the desired injection pressure, $P_{inj}$, is reached, switching off a high pressure pump and closing a pressure regulator; measuring an overall leakage on variations of the rail pressure across an engine cycle for the motor vehicle and between two engine positions of an internal combustion engine for the motor vehicle, wherein the overall leakage on the variations of the rail pressure defined as $DP_{LEAK}=P_{a,LEAK}-P_{b,LEAK}$, where $P_{a,LEAK}$ is measured at $\Theta_a$ and $P_{b,\ LEAK}$ is measured at $\Theta_p$, where $\Theta_a$ and $\Theta_b$ are two different angles of a crankshaft of the internal combustion engine; energizing the injector with an energization-time, $ET_{inj}$, after an inherent cylinder top-dead-center, TDC, to not produce a torque; measuring injection and leakage effects on the rail pressure variation defined as $DP_{INJ+LEAK}=P_{a,INJ}-P_{b,INJ}$, where $P_{a,INJ}$ is measured at $\Theta_a$ and $P_{b,INJ}$ is measured at $\Theta_b$; calculating the injection effect on the rail pressure defined as $DP_{inj}=DP_{INJ+LEAK}-DP_{LEAK}$; and calculating an actual injected quantity, $Q_{inj}$, as a function of $DP_{inj}$ and $P_{inj}$.

In another aspect of the present disclosure, the method further includes restarting a new measurement cycle for a new pressure measurement target.

In another aspect of the present disclosure, restarting includes restarting when a current pressure level is utilized as a new pressure measurement target.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
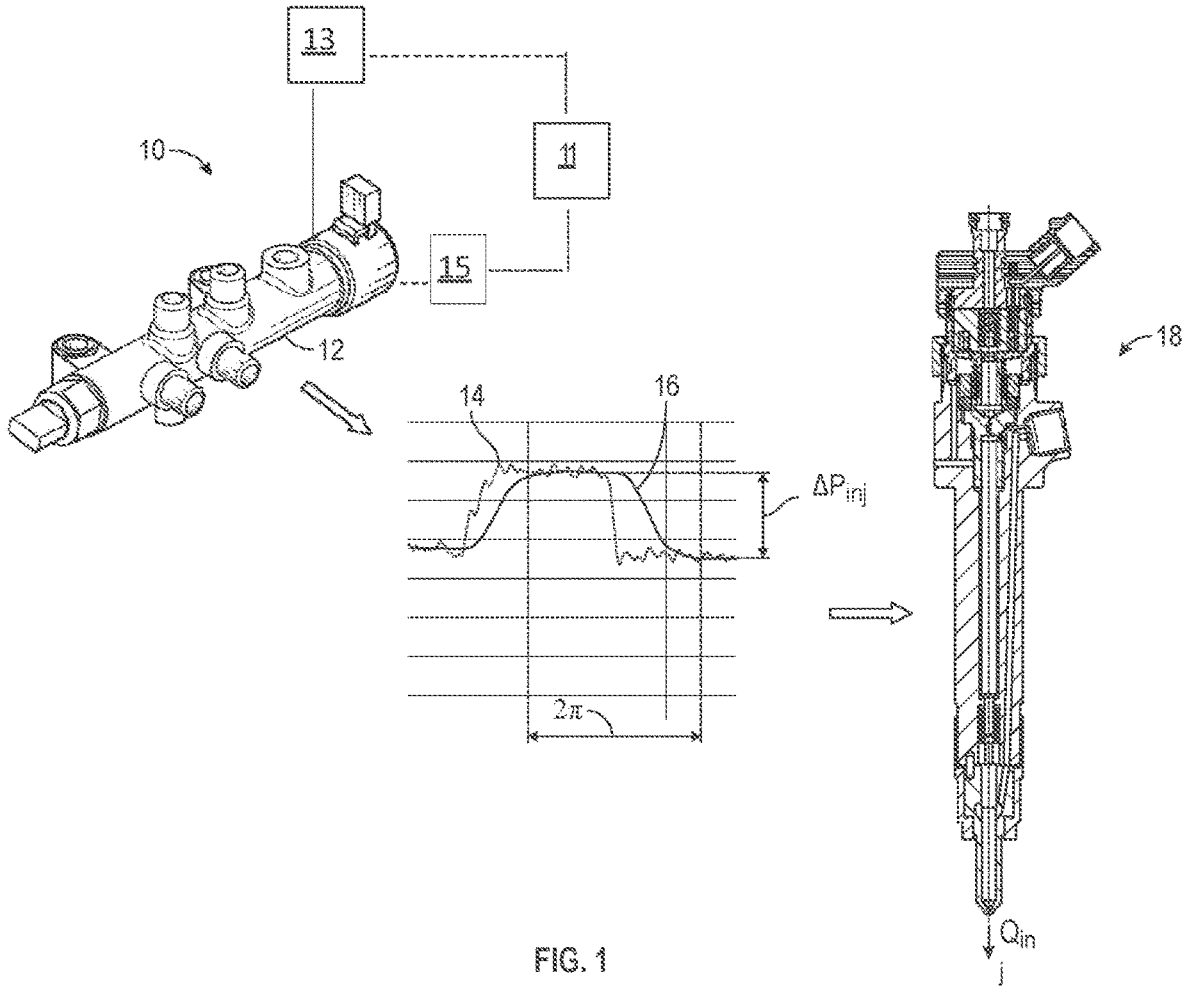
FIG. 1 illustrates a portion of a fuel injection system according to an exemplary embodiment.

Referring to FIG. 1, there is shown a portion of a fuel injection system 10 for a motor vehicle. A fuel and air mixture is disposed in a combustion chamber of an internal combustion engine and ignited, resulting in hot expanding exhaust gasses causing reciprocal movement of a piston. The fuel is provided by at least one fuel injector 18 per combustion chamber and the air through at least one intake port. The fuel is provided at high pressure to the fuel injector 18 from a fuel rail 12 in fluid communication with a high pressure fuel pump 13.

The injection system 10 further includes an electronic control unit (ECU) 11 in communication with one or more pressure regulators 15 and the high pressure fuel pump 13. The ECU 11 may receive input signals from various sensors configured to generate the signals in proportion to various physical parameters associated with the fuel injection system 10. Furthermore, the ECU 11 may generate output signals to various control devices that are arranged to control the operation of the fuel injection system 10, including, but not limited to, the fuel injectors 18.

Turning now to the ECU 11, this apparatus may include a digital central processing unit (CPU) in communication with a memory system and an interface bus. The CPU is configured to execute instructions stored as a program in the memory system, and send and receive signals to/from the interface bus. The memory system may include various non-transitory, computer-readable storage medium including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the fuel injection system 10.

The program stored in ECU 11 is transmitted from outside via a cable or in a wireless fashion. Outside the motor vehicle, it is normally visible as a computer program product, which is also called computer readable medium or machine readable medium in the art, and which should be understood to be a computer program code residing on a carrier, the carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 11, the fuel injection system 10 may have a different type of processor to provide the electronic logic, e.g. an embedded controller, an onboard computer, or any processing module that might be deployed in the vehicle. One of the tasks of the ECU 11 is that of operating the fuel injectors 18 to inject fuel into the combustion chambers. In this regard, it should be observed that each fuel injector 18 is generally embodied as an electromechanical valve having a nozzle in fluid communication with the corresponding combustion chamber, a needle, which is normally biased by a spring in a closed position of the nozzle, and an electro-magnetic actuator (e.g. solenoid), which moves the needle towards an open position of the nozzle in response of an energizing electrical current. In this way, any time the electro-magnetic actuator is provided with the energizing electrical current (also named electrical command), a direct connection is opened between the fuel rail 12 and the cylinder, which let a certain quantity of fuel to be injected into the combustion chamber. Any one of these events is conventionally referred as "injection pulse".

During normal operations, the ECU 11 generally commands each fuel injector 18 to perform a "fuel injection" per engine cycle, wherein the fuel injection includes a plurality of injection pulses according to a multi-injection pattern. The timing of each single injection pulse generally depends on the instant when the electric command is applied to the actuator of the fuel injector 18. Therefore, the ECU 11 is generally configured to determine the Start Of Injection (SOI) of the injection pulse and then to start the application of the electric command accordingly. The SOI is generally expressed as the angular position of the engine crankshaft when the fuel injection starts. This angular position is normally quantified as an angular displacement, namely a difference between the angular position of the crankshaft at the time when the fuel injection starts and a predetermined angular position of the crankshaft, which is chosen as a reference. The reference angular position of the crankshaft is usually chosen as the position for which the piston reaches the Top Dead Center (TDC).

The fuel quantity injected into the combustion chamber by each single injection pulse generally depends on the pressure of the fuel in the fuel rail 12 and on the needle displacement, which is correlated with the duration of the electrical command (i.e. energizing time ET). Therefore, the ECU 11 is generally configured to determine the fuel quantity to be injected with each single injection pulse, to calculate the energizing time necessary for injecting, the desired fuel quantity, and finally to energize the fuel injector 18 accordingly.

However, the SOI and/or the quantity of fuel actually injected by the fuel injector 18 may sometimes be different with respect to the desired ones, due to aging effect and/or production spread of the fuel injector 18. For this reason, the ECU 11 may be configured to perform a method for determining the real SOI and the real quantity of fuel injected by each of the fuel injector 18 in response to a given energizing time, for example in order to diagnose the efficiency of the injection system and/or to be able to correct the electric command with the aim of injecting exactly a desired fuel quantity and/or with the desired timing.

This method may be performed while the engine is under a cut-off condition, for example but not exclusively during the execution of a stop-start running strategy, and may require that the ECU 11 operates one fuel injector 18 at the time, while keeping the other inactive. In the graph shown in the middle of FIG. 1, over a cycle of $2\pi$, the fuel injection system 10 receives a raw pressure signal 14 and provides a filtered pressure signal 16 for a change in injection pressure $\Delta P_{inj}$.

Figure 2:
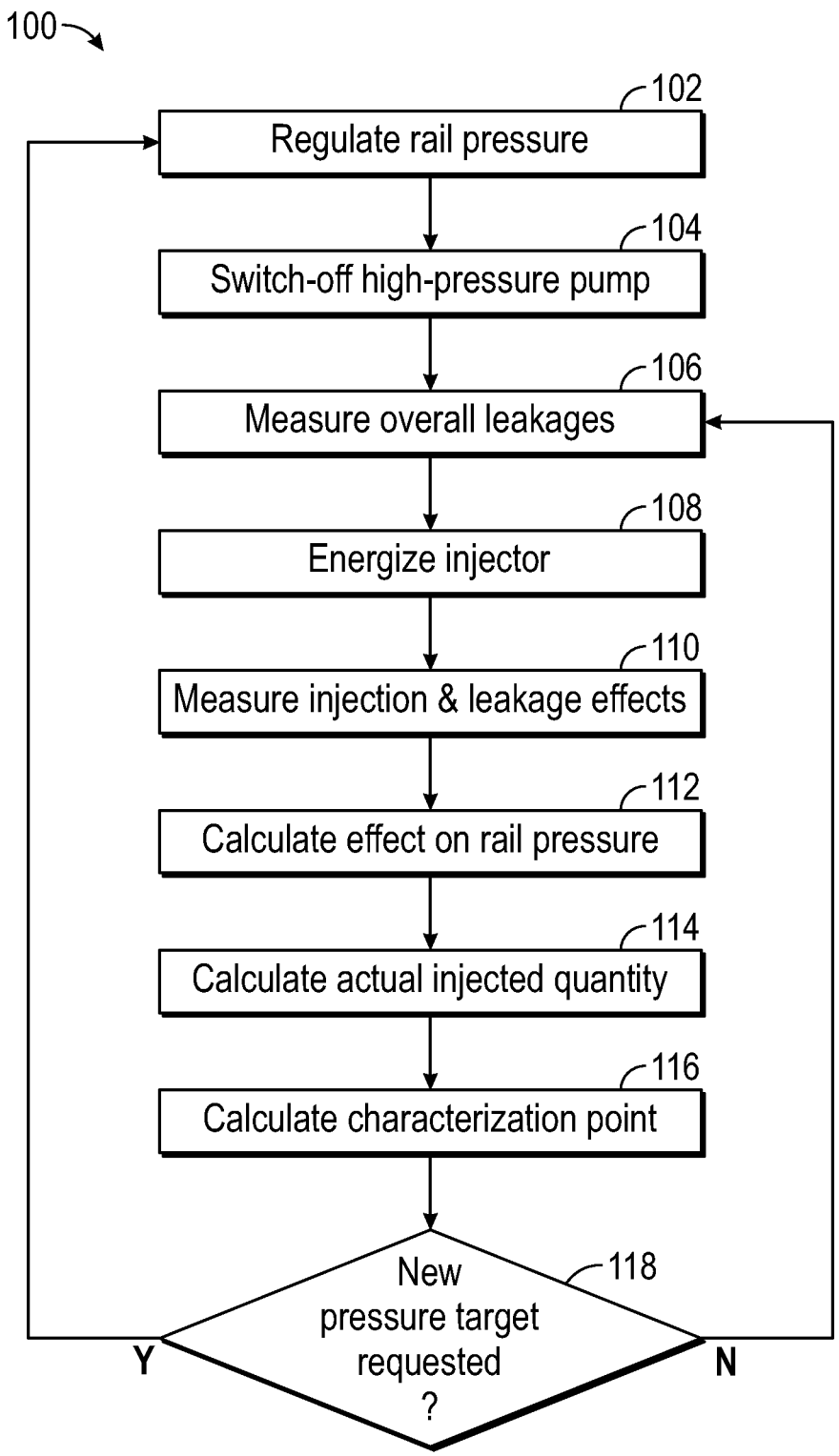
FIG. 2 is a flow diagram of a process to operate the fuel injection system according to an exemplary embodiment.

Referring further to FIG. 2, there is shown a process 100 in which the fuel injection system 10 accommodates for fuel leakage in the fuel injection system 10. In step 102, the process 100 regulates the pressure in the rail 12 at a desired level $P_{inj}$. In step 104, after the desired pressure level $P_{inj}$ is reached, the high pressure pump 13 is turned off the pressure regulator 15 is closed. In step 106, the process 100 measures an overall leakage on variations of the rail pressure across an engine cycle for the motor vehicle and between two engine positions of an internal combustion engine for the motor vehicle. The overall leakage on the variations of the rail pressure is defined as $DP_{LEAK}=P_{a,LEAK}-P_{b,LEAK}$, where $P_{a,LEAK}$ is measured at $\Theta_a$ and $P_{b,\ LEAK}$ is measured at $\Theta_b$, and where $\Theta_a$ and $\Theta_b$ are two different angles of a crankshaft of the internal combustion engine.

Next, in step 108, the process 100 energizes the injector 18 with an energization-time, $ET_{inj}$, after an inherent cylinder top-dead-center, TDC, to not produce a torque. And in step 110, the process 100 measures injection and leakage effects on the rail pressure variation defined as $DP_{INJ+LEAK}=P_{a,INJ}-P_{b,INJ}$, where $P_{a,INJ}$ is measured at $\Theta_a$ and $P_{b,INJ}$ is measured at $\Theta_b$.

Subsequently, the process 100, in step 112, calculates the injection effect on the rail pressure defined as $DP_{inj}=DP_{INJ+LEAK}-DP_{LEAK}$. And, in step 114, an actual injected quantity, $Q_{inj}$, as a function of $DP_{inj}$ and $P_{inj}$.

Figure 3:
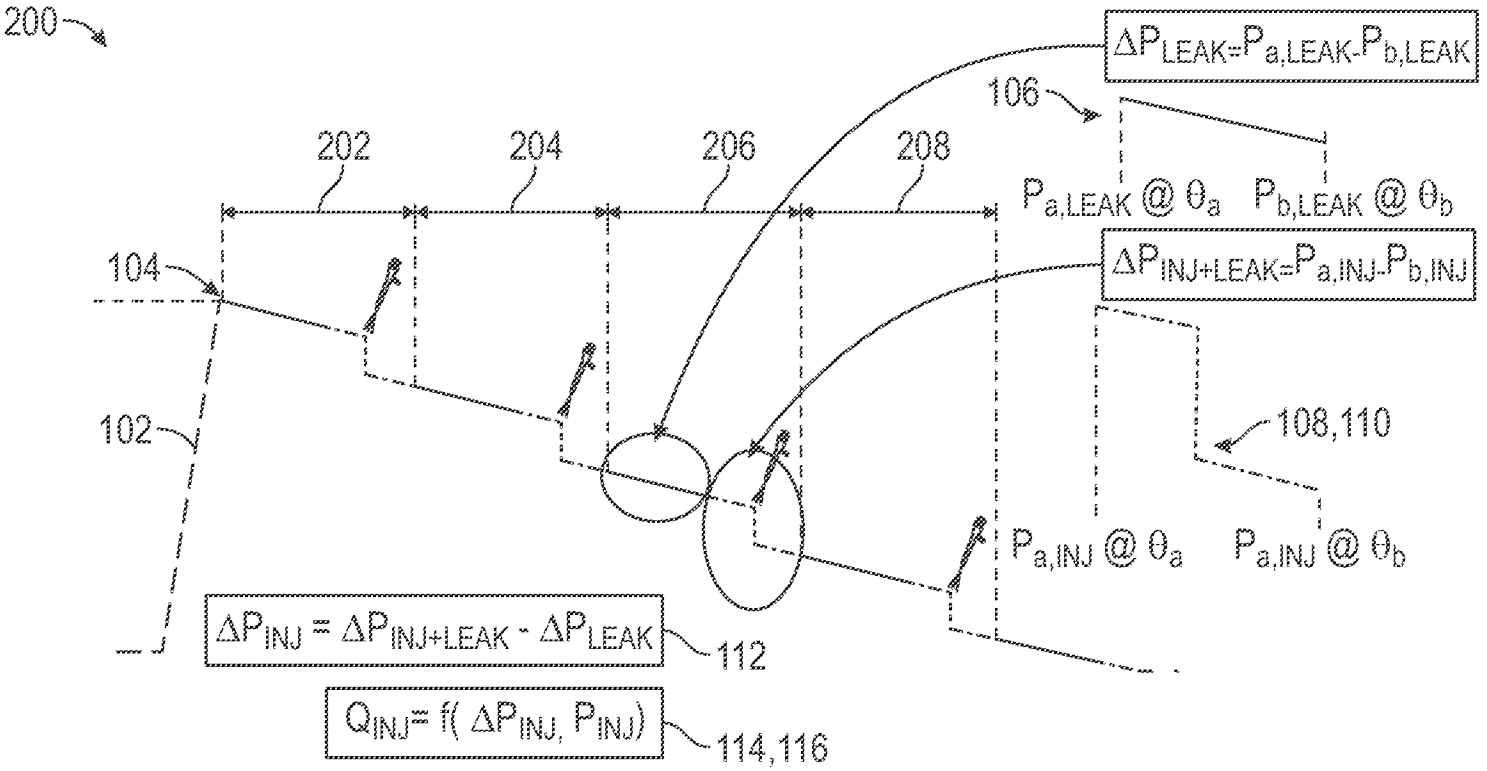
FIG. 3 is a schematic graph of the process to operate the fuel injection system according to an exemplary embodiment.

In step 116, the process 100 collects a characterization point as a function of $Q_{inj}$, $P_{inj}$ and $ET_{inj}$ into memory of an electronic control unit 11. In step 118, the process 100 determines if a new target pressure is requested. If the determination is yes, the process 100 returns to step 102. Or if the current pressure level is utilized as a new measurement pressure target, the process 100 returns to step 106. As shown in FIG. 3, the process 100 is implemented in a sequence 200 of multi-injections of the fuel injector 18. More specifically, FIG. 3 illustrates multiple injections 202, 204, 206 and 208 of the fuel injection system 10 in which leakages occur between fuel injections and specific steps of the process 100 are identified by the appropriate step in the sequence 200.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of operating a fuel injection system for a motor vehicle, the method comprising:

operating a fuel injector to perform a fuel injection, the fuel injector being in fluid communication with a fuel rail;

sampling a rail pressure in the fuel rail during the fuel injection;

regulating the rail pressure at a desired injection pressure, $P_{inj}$, to the fuel injector;

measuring an overall leakage on variations of the rail pressure across an engine cycle for the motor vehicle and between two engine positions of an internal combustion engine for the motor vehicle; and determining if a new target pressure is requested, wherein if the new target pressure is requested, the rail pressure is regulated at the new target pressure, and wherein if the new target pressure is not requested, the current rail pressure is utilized to measure overall leakages of the rail pressure.

2. The method of claim 1, wherein restarting includes restarting when a current pressure level is utilized as a new pressure measurement target.

3. The method of claim 1, wherein the overall leakage on the variations of the rail pressure defined as $DP_{LEAK}=P_{a,LEAK}-P_{b,\ LEAK}$.

4. The method of claim 3, wherein $P_{a,LEAK}$ is measured at $\Theta_a$ and $P_{b,\ LEAK}$ is measured at $\Theta_b$, where $\Theta_a$ and $\Theta_b$ are two different angles of a crankshaft of the internal combustion engine.

5. The method of claim 4, further comprising energizing the injector with an energization-time, $ET_{inj}$, after an inherent cylinder top-dead-center, TDC, to not produce a torque.

6. The method of claim 5, further comprising measuring injection and leakage effects on the rail pressure variation defined as $DP_{INJ+LEAK}=P_{a,INJ}-P_{b,INJ}$.

7. The method of claim 6, wherein $P_{a,INJ}$ is measured at $\Theta_a$ and $P_{b,\ INJ}$ is measured at Θb.

8. The method of claim 7, further comprising calculating the injection effect on the rail pressure defined as $DP_{inj}=DP_{INJ+LEAK}-DP_{LEAK}$.

9. The method of claim 8, further comprising calculating an actual injected quantity, $Q_{inj}$, as a function of $DP_{inj}$ and $P_{inj}$.

10. The method of claim 9, further comprising collecting a characterization point as a function of $Q_{inj}$, $P_{inj}$ and $ET_{inj}$ into memory of an electronic control unit.

11. A method of operating a fuel injection system for a motor vehicle, the method comprising:

operating a fuel injector to perform a fuel injection, the fuel injector being in fluid communication with a fuel rail;

sampling a rail pressure in the fuel rail during the fuel injection;

regulating the rail pressure at a desired injection pressure, $P_{inj}$, to the fuel injector;

after the desired injection pressure, $P_{inj}$, is reached, switching off a high pressure pump and closing a pressure regulator;

measuring an overall leakage on variations of the rail pressure across an engine cycle for the motor vehicle and between two engine positions of an internal combustion engine for the motor vehicle;

energizing the injector with an energization-time, $ET_{inj}$, after an inherent cylinder top-dead-center, TDC, to not produce a torque;

calculating an injection effect on the rail pressure, $DP_{inj}$;

calculating an actual injected quantity, $Q_{inj}$, as a function of $DP_{inj}$ and $P_{inj}$;

collecting a characterization point as a function of $Q_{inj}$, $P_{inj}$ and $ET_{inj}$ into memory of an electronic control unit; and determining if a new target pressure is requested, wherein if the new target pressure is requested, the rail pressure is regulated at the new target pressure, and wherein if the new target pressure is not requested, the current rail pressure is utilized to measure overall leakages of the rail pressure.

12. The method of claim 11, wherein the overall leakage on the variations of the rail pressure is defined as $DP_{LEAK}=P_{a,LEAK}-P_{b,\ LEAK}$, where $P_{a,LEAK}$ is measured at $\Theta_a$ and $P_{b,\ LEAK}$ is measured at $\Theta_b$, where $\Theta_a$ and $\Theta_b$ are two different angles of a crankshaft of the internal combustion engine.

13. The method of claim 12, further comprising measuring injection and leakage effects on the rail pressure variation defined as $DP_{INJ+LEAK}=P_{a,INJ}-P_{b,INJ}$ and wherein $P_{a,INJ}$ is measured at $\Theta_a$ and $P_{b,INJ}$ is measured at $\Theta_b$.

14. The method of claim 13, wherein the injection effect on the rail pressure is defined as $DP_{inj}=DP_{INJ+LEAK}-DP_{LEAK}$.

15. The method of claim 11, further comprising collecting a characterization point as a function of $Q_{inj}$, $P_{inj}$ and $ET_{inj}$ into memory of an electronic control unit.

16. A method of operating a fuel injection system for a motor vehicle, the method comprising:

operating a fuel injector to perform a fuel injection, the fuel injector being in fluid communication with a fuel rail;

sampling a rail pressure in the fuel rail during the fuel injection;

regulating the rail pressure at a desired injection pressure, $P_{inj}$, to the fuel injector;

after the desired injection pressure, $P_{inj}$, is reached, switching off a high pressure pump and closing a pressure regulator;

measuring an overall leakage on variations of the rail pressure across an engine cycle for the motor vehicle and between two engine positions of an internal combustion engine for the motor vehicle, wherein the overall leakage on the variations of the rail pressure defined as $DP_{LEAK}=P_{a,LEAK}-P_{b,LEAK}$, where $P_{a,LEAK}$ is measured at $\Theta_a$ and $P_{b,\ LEAK}$ is measured at $\Theta_b$, where $\Theta_a$ and $\Theta_b$ are two different angles of a crankshaft of the internal combustion engine;

energizing the injector with an energization-time, $ET_{inj}$, after an inherent cylinder top-dead-center, TDC, to not produce a torque;

measuring injection and leakage effects on the rail pressure variation defined as $DP_{INJ+LEAK}=P_{a,INJ}-P_{b,INJ}$, where $P_{a,INJ}$ is measured at $\Theta_a$ and $P_{b,INJ}$ is measured at $\Theta_b$;

calculating the injection effect on the rail pressure defined as $DP_{inj}=DP_{INJ+LEAK}-DP_{LEAK}$;

calculating an actual injected quantity, $Q_{inj}$, as a function of $DP_{inj}$ and $P_{inj}$; and determining if a new target pressure is requested, wherein if the new target pressure is requested, the rail pressure is regulated at the new target pressure, and wherein if the new target pressure is not requested, the current rail pressure is utilized to measure overall leakages of the rail pressure.

* * * * *